US008251082B2

(12) United States Patent
Ross et al.

(10) Patent No.: US 8,251,082 B2
(45) Date of Patent: Aug. 28, 2012

(54) DUAL VALVE METHOD AND APPARATUS FOR LIMITING TOILET WATER FLOW

(76) Inventors: Rodger Lynn Ross, Marlin, TX (US); Donna H Ross, Marlin, TX (US)

( * ) Notice: Subject to any disclaimer, the term of this patent is extended or adjusted under 35 U.S.C. 154(b) by 656 days.

(21) Appl. No.: 12/168,158

(22) Filed: Jul. 7, 2008

(65) Prior Publication Data

US 2011/0203672 A1 Aug. 25, 2011

Related U.S. Application Data

(60) Provisional application No. 60/955,902, filed on Aug. 15, 2007.

(51) Int. Cl.
*E03B 1/00* (2006.01)

(52) U.S. Cl. ..... 137/15.19; 137/613; 137/460; 4/378

(58) Field of Classification Search ..... 137/613, 137/460, 15.19; 4/323, 355, 356, 366, 378
See application file for complete search history.

(56) References Cited

U.S. PATENT DOCUMENTS 3,842,857 A 10/1974 McCornack
4,659,059 A 4/1987 Morris et al.
4,700,413 A * 10/1987 Lopez ..... 4/324
4,843,657 A * 7/1989 Orr ..... 4/405
5,125,120 A 6/1992 Baron
5,775,366 A * 7/1998 Ray et al. ..... 137/410
6,088,846 A * 7/2000 Baron ..... 4/366
6,237,618 B1 5/2001 Kushner
7,210,498 B2 5/2007 Arigoni
7,293,583 B2 11/2007 Arigoni
7,380,567 B2 * 6/2008 Schmitt ..... 137/460
2006/0254651 A1 11/2006 Hodge et al.

OTHER PUBLICATIONS

International search report for related PCT application PCT/US11/36183, Aug. 18, 2011.
CH II Demand for related PCT Application PCT/US2011/36183, Nov. 2011.

* cited by examiner

*Primary Examiner* — Kevin Lee
(74) *Attorney, Agent, or Firm* — Rick B. Yeager

(57) ABSTRACT

A dual valve assembly for limiting flow into a toilet tank comprises a fill valve, such as a float valve or ball cock valve, and a piston valve positioned between a water supply line and the fill valve. The piston valve operates independently of the fill valve, and is designed to shut off water flow after an approximate flow volume or time. The dual valve assembly may be provided in a single housing replacement part. The dual valve assembly may be provided as an adapter kit comprising a housing and piston valve which is installed in a toilet tank to accept a fill valve.

14 Claims, 5 Drawing Sheets

DUAL VALVE METHOD AND APPARATUS FOR LIMITING TOILET WATER FLOW

RELATED APPLICATIONS

This non-provisional patent application is related to U.S. Provisional Application No. 60/955,902 filed Aug. 15, 2007 by applicants and claims the benefit of that filing date.

BACKGROUND

1. Field of Invention

The current invention relates to a method and apparatus for a toilet flow control device, and more particularly to providing a piston valve device in combination with a toilet fill valve in order to save water in the event of flapper or fill valve malfunction.

2. Prior Art

Leaking toilets are a very large source of wasted water. Many homeowners and rental property owners have not discovered leakage until they investigate the reason for an unusually high water bill. Smaller leaks may go undetected for months or years. There is a need for a simple, reliable, and economical device for reducing or eliminating leakage in toilets.

Running or leaking toilets can be caused by several factors including (a) a stuck flapper valve; (b) a malfunctioning fill valve, and (c) an improperly adjusted fill valve or float causing water to rise above the overflow tube. The present invention prevents a waste of water under any of those conditions. By contrast, prior art devices typically address only some of these factors.

Piston Valve Devices

In one embodiment of the current invention, a manually resetting shutoff piston valve is provided that is preset to stop water flow after a period of time, such as three minutes. In this specification and claims, the term "piston valve" or "push valve" refers to a valve where a piston moves from an open mode to a closed mode in order to open or close the valve. The piston is typically opened by a manual force, and typically closes more slowly than it is opened. Piston valves are used in the faucets of many public restrooms. By contrast, a "turbine meter" uses a combination of an impeller or turbine with gears as a valve-closing mechanism.

In one embodiment of the current invention, when the flush lever of the toilet is pushed, a pivoting lever drives a piston to an open position, so that the piston valve permits an approximate total flow volume before it closes and prevents further flow until the next flush event.

U.S. Pat. No. 4,659,059 to Morris et al. describes one example of a piston valve which comprises an improved, delayed closing plumbing valve of the type having a cartridge with hydraulic fluid in a sealed chamber retained between an upper and lower diaphragm positioned about a longitudinally movable valve stem assembly. The chamber has a one-way piston which divides the chamber into an upper and lower section, and there is a restricted fluid flow path between the two sections. A water shut off gasket is at the base of a valve stem and has a removable gasket ring to permit the replacement of the gasket. The valve seat may also be removable for replacement. The lower diaphragm is provided with a sealed chamber to prevent its degradation by particles in the water. The diaphragms at the upper and lower end of the chamber are retained and sealed to the valve stem by retaining rings having a conical upper end which holds the inner part of the diaphragm against the valve stem. The diaphragms preferably permit the turning of the valve stem with respect to the cartridge without damage to the diaphragms.

U.S. Pat. No. 3,842,857 to McCornack describes a piston valve device for a toilet. Several subsequent piston valve device patents reference the McCornack patent.

Volume Turbine Meter Valve in Tank

U.S. Pat. No. 5,125,120 to Baron describes a toilet water regulator device which prohibits water flow into the toilet system after a predetermined amount of water has entered the system comprising a valve at the water inlet to the system, said valve having a water outlet to the system, wherein the flow of water through said valve is controlled by turbine means associated with the water outlet of the valve and the amount of water predetermined necessary to fill the tank is controlled by adjustable valve means.

U.S. Pat. No. 7,210,498 to Arigoni describes a turbine valve used in combination with a float valve. One object of the current invention is to provide a piston valve device with a self-cleaning capability to reduce risks of fouling present with turbine meter devices. An object of one embodiment of the present invention is to provide an adapter device where float valve or piston valve components may be replaced without removing a housing from the toilet tank. An object of one embodiment of the present invention is to provide a low profile manifold housing which permits use of a relatively tall float valve assembly.

Monitoring or Meter Valve for House

U.S. Pat. No. 6,237,618 to Kushner describes a system which includes a flow meter that connects to the water supply line, wherein the flow meter produces a water flow signal indicative of the volume of water flowing through the water supply line. A systems controller is provided that is connected to both the valve and the flow meter. The systems controller is configurable between a first operations mode and a second operations mode. The systems controller reads the water flow signal from the flow meter and closes the valve at a first flow rate when it is in its first operations mode. Similarly, the systems controller closes the valve at a second flow rate when it is in its second operations mode. When the flow meter detects an excessive volume flow, the systems controller only closes the valve if the excessive flow persists beyond a predetermined period of time. The predetermined period of time has a duration of at least ten seconds.

Time Meter

U.S. Pat. No. 7,293,583 to Lee describes a "Countdown timer" automatic water limiting supply shut off safety valve flo-control system.

US Patent Publication No. 2006-0254651 by McCalister describes fluid sensing shut-off devices with timer and methods of operation.

There is a need for a simple and reliable mechanical device which prevents water waste in the event of flapper malfunction, flapper leakage, fill valve mis-adjustment, and fill valve leakage. The current invention addresses that need.

SUMMARY OF INVENTION

In one embodiment of the current invention, a dual valve assembly is provided for limiting flow into a toilet tank. The dual valve assembly comprises a housing which includes a portion that extends through a toilet tank supply hole and is connected to a water supply line; a fill valve, such as a float valve or ball cock valve; and a piston valve positioned between a water supply line and the fill valve. The piston valve operates independently of the fill valve, and is designed to shut off water flow after an approximate flow volume or time. In another embodiment, the fill valve is positioned between the water supply line and the piston valve.

In one embodiment, the dual valve assembly is provided in a single housing replacement part.

In another embodiment, the dual valve assembly is provided as an adapter kit comprising a housing and piston valve which is installed in a toilet tank. After the adapter kit is installed, a fill valve such as a float valve is attached to the housing. The fill valve may be a standard size valve, or may be adapted for use with the adapter kit—such as a short float valve.

ELEMENT LIST

Figure 1:
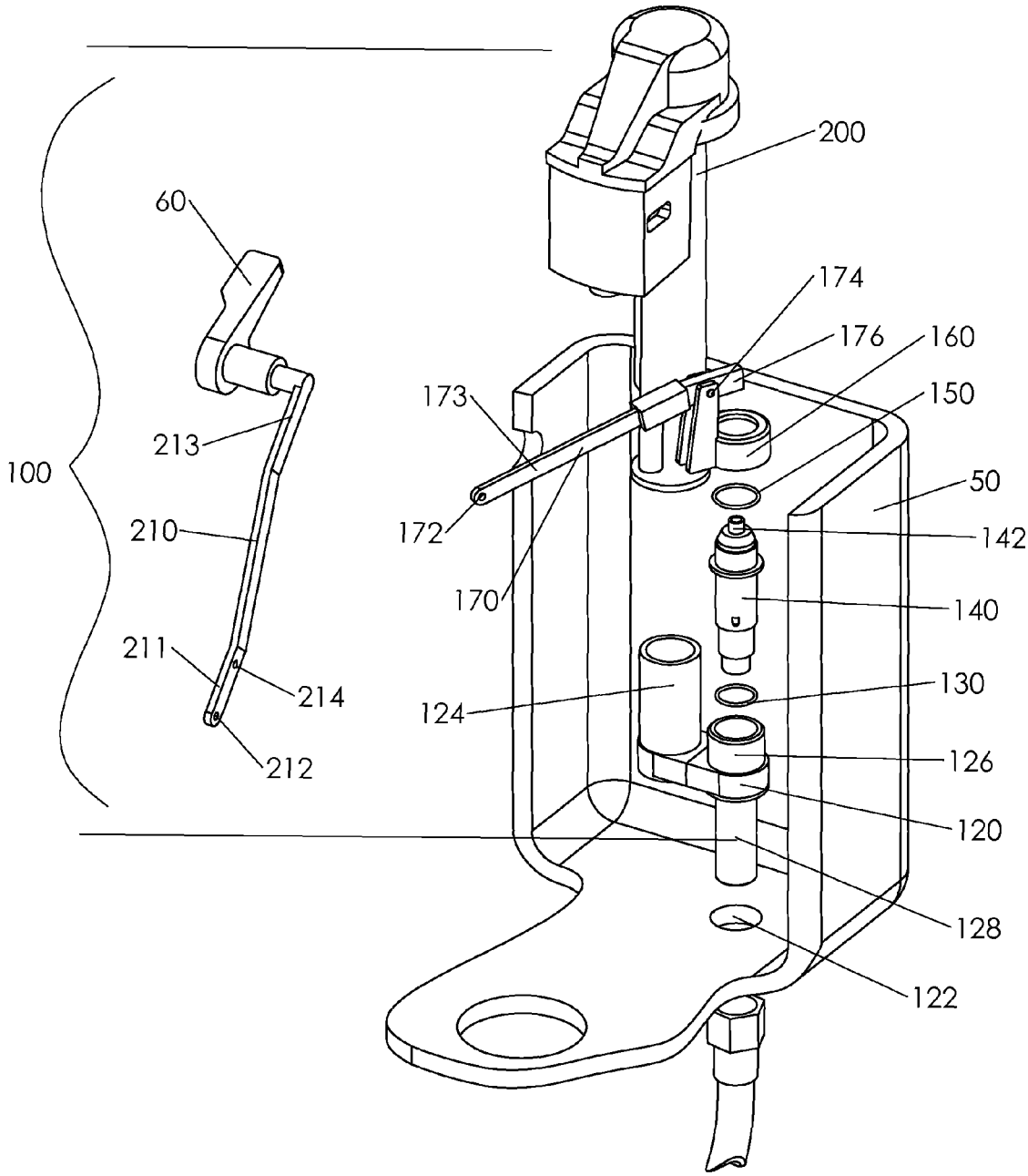
FIG. 1 shows a portion of a toilet tank with an exploded dual valve assembly of one embodiment of the current invention.

The following element numbers are used in the specification and figures.

toilet tank 50
water supply inlet hole 52
water supply line 54
toilet handle 60
dual valve assembly 100
manifold 120
lower manifold portion 122
fill valve support portion 124
piston valve housing 128 portion of the manifold
top 126 of the piston valve housing
first O-ring 130
piston valve 140
piston valve actuator 142
second O-ring 150
cap 160
piston valve actuating arm 170
first end portion 173
piston valve actuating arm pivot point 174
second end portion 176
float valve 200
flapper arm 210
distal end 211
proximal end 213
flapper chain support hole 212
piston valve actuating arm chain support hole 214
piston valve actuating arm chain 220
flapper chain 230
ball cock valve 270
ball float 272

Description of Embodiment

Dual Float Valve and Piston Valve Assembly

Figure 2:
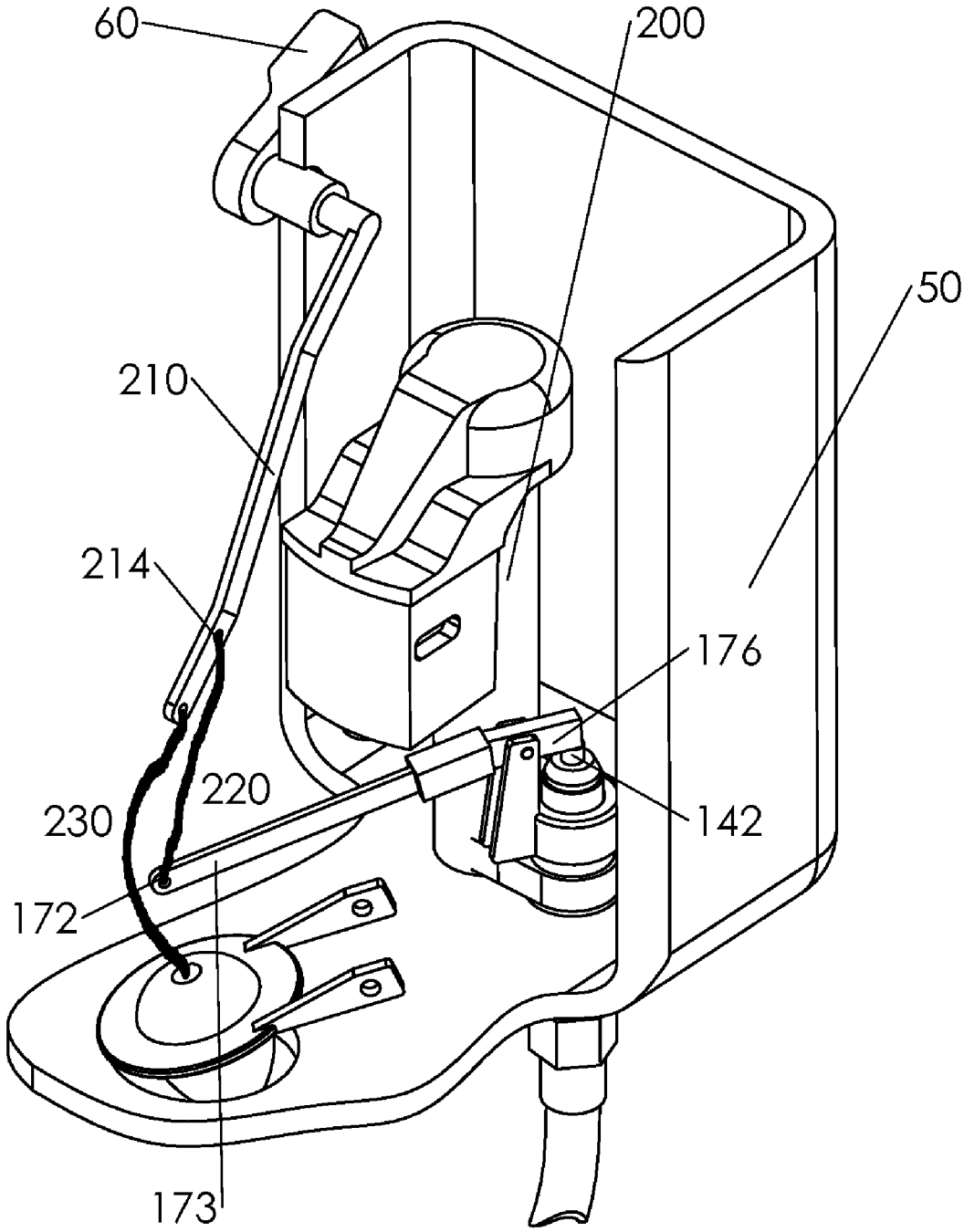
FIG. 2 is a perspective view of an assembled device of FIG. 1.

FIG. 1 shows a portion of a toilet tank 50 with an exploded dual valve assembly 100 of one embodiment of the current invention. FIG. 2 is a perspective view of an assembled device of FIG. 1.

Manifold

In this embodiment, a water supply line is provided at the tank near the water supply inlet hole 52. In prior art devices, a lower portion of a float valve typically protrudes through this water supply inlet hole so that a water supply line can be attached to the float valve. A float valve is one example of a fill valve. In this embodiment, a manifold 120 includes a lower manifold portion 122 and a fill valve support portion 124. The lower portion is partially inserted through the water supply inlet hole 52 and secured to the tank. Typically, the lower portion is threaded, and a locking nut (not shown) is installed on the threaded portion and then tightened against the tank bottom. A washer (not shown) is typically provided to seal between the manifold and the tank. The manifold may be made of plastic or any other suitable material.

Piston Valve

In this embodiment, a prefabricated piston valve 140 is provided in a piston valve housing 128 portion of the manifold. One example of a piston valve is provided by Acorn Engineering Company which provide "volume metering valves" which meter the volume of hydraulic fluid flow through the meter when the valve is opened, and then close after a designated volume of water has flowed through the valve.

In this embodiment, a first O-ring 130 is provided between the lower portion of the piston valve and a valve seat (not shown) provided in the manifold. A second O-ring 150 is provided between the upper portion of the piston valve and a valve seat (not shown) provided in the manifold. A cap 160 is provided to fit over the top 126 of the piston valve housing. A piston valve actuator 142 is provided on the upper portion of the piston valve 140. In this embodiment, when the piston valve actuator 142 is depressed, the piston valve is opened for a preset time or flow volume.

A piston valve actuating arm 170 is supported in proximity to the cap 160, so that when a first end portion 173 of the piston valve actuating arm 170 is raised, the arm pivots at piston valve actuating arm pivot point 174, thereby causing the second end portion 176 of the piston valve actuating arm to depress the piston valve actuator 142.

In this embodiment, a portion of the piston valve is positioned in the manifold such that a portion of the valve is located below the bottom of the tank. This positioning reduces the displacement volume and height of the housing in the tank. In this example, the piston valve discharges the fill valve support portion 124 oriented to the side of the piston valve. This orientation provides an advantage of permitting a relatively tall float valve, thereby reducing adaptations required, if any, for float valves to be used in combination with the piston valve. The orientation also permits a direct access to the piston valve actuator 142, so that the actuation mechanism may be simplified.

Tank Level Control Valve

Prior art devices include various types of tank level control fill valves for a toilet tank. These fill valve devices include float valves which open when a float element is lowered and close when the float element is raised; pressure sensing elements for detecting the pressure of water above the pressure sensing element, timer elements which close after a set duration of flow, and flow elements which close after a set flow of water through the element. The most common type of tank level control fill valve is a float valve. In addition to the basic function of closing a valve when a float element reaches a set level in the tank, some float valves have features such as preventing the float to drop until the toilet is flushed. This type of feature is intended to keep the float valve closed when water leaks past a flapper valve. In this patent specification and claims, the terms "tank level control fill valve" or "fill valve" includes float valves and pressure sensing valves. The term "tank level control fill valve" or "fill valve" also refer to metering valves which are designed to serve as the primary level control for a tank. For instance, one embodiment of the current invention is to provide a dual valve device where a first valve serves the primary function of stopping water flow at the approximate time that a tank fills with water, and a second metering valve which serves a backup function of preventing additional flow beyond a set volume or time. In this example, the first valve may also be a metering valve.

In this example, the tank level control fill valve is a float valve 200 which is supported by the fill valve support portion 124 of the manifold. In this embodiment, the float valve operates in a conventional manner by opening when the toilet handle 60 is engaged, and by remaining open until a designated height of water in the tank has been achieved. The toilet handle or lever is part of a tank flush mechanism. A flapper arm 210 is connected to the toilet handle 60 at proximal end 213 of the flapper arm, so that when the toilet handle is depressed, distal end 211 of the flapper arm 210 is raised, thereby raising flapper chain support hole 212 which typically holds a flapper chain 230 connected to a flapper valve (not shown). In this embodiment, piston valve actuating arm chain support hole 214 is also raised thereby pulling a piston valve actuating arm chain 220 and thereby lifting meter hole 172 and piston valve actuating arm 170.

Figure 3:
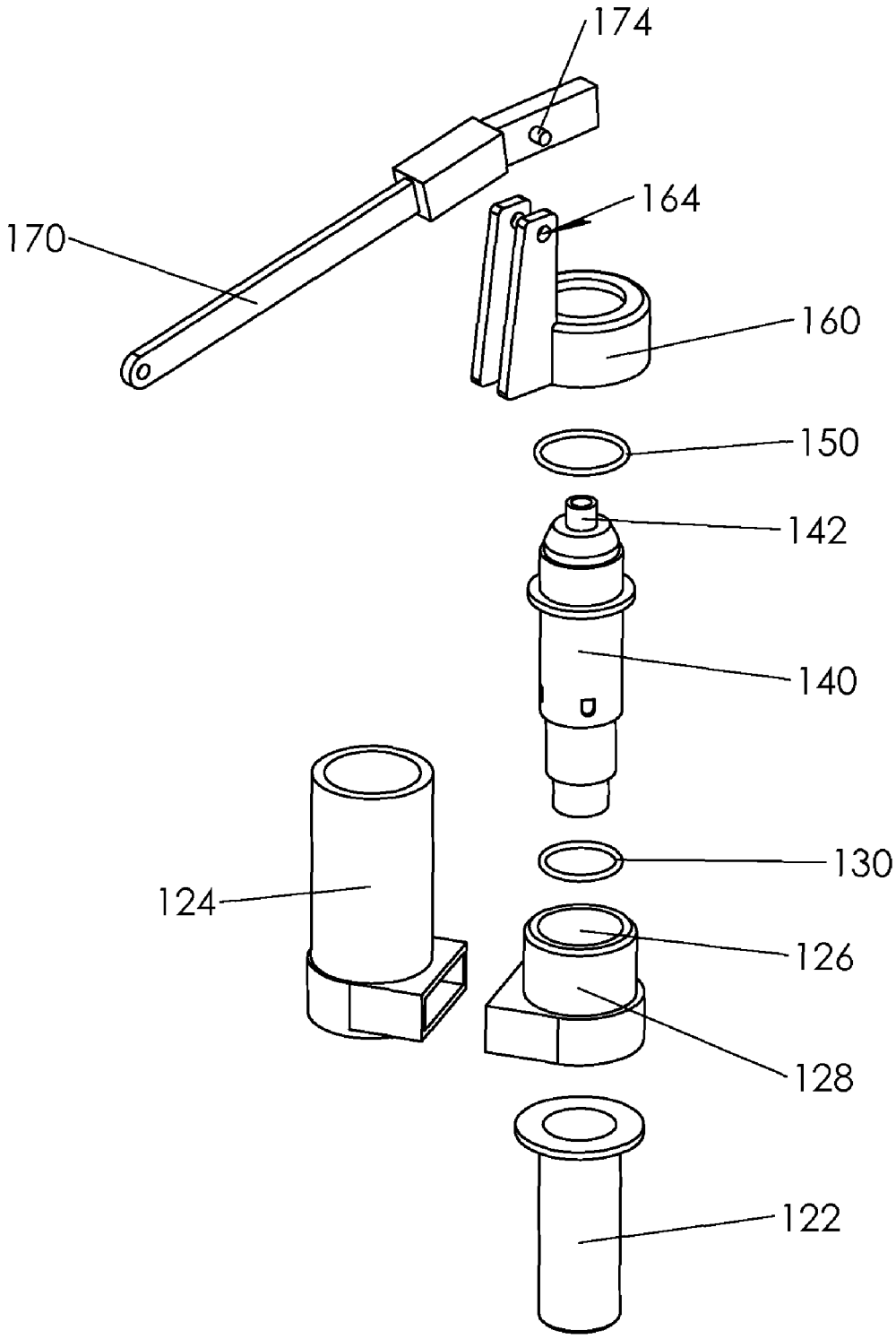
FIG. 3 is an exploded diagram of one example of a manifold and piston valve of the embodiment of FIG. 1

FIG. 3 is an exploded diagram of one example of the manifold 120 of FIG. 1. In this example, the manifold is manufactured by the assembly of separate pieces including a lower portion 122, a fill valve support portion 124, a piston valve housing section 128, a piston valve 140, O-rings 130 and 150, and a cap section 160.

Operation

In this embodiment, a piston valve serves as a shutoff valve on the supply side of the fill valve. The piston valve operates independently of the fill valve to prevent a continued waste of water in various failure modes as described below. In other embodiments, the piston valve serves as a shutoff valve on the discharge side of the fill valve.

In this embodiment, the piston valve is manually reset when the toilet handle is engaged such as by depressing a flush lever. In this embodiment, when the flush lever 60 is depressed, the distal end 211 of the flapper arm 210 is raised. As the distal end 211 is raised, flapper chain 230 is pulled upward, thereby raising the flapper. Also, as the distal end 211 is raised, flapper chain 230 is pulled upward, piston valve actuating arm chain 220 is pulled upward, thereby raising end 173 and lowering end 176 of piston valve actuating arm 170. As end 176 of piston valve actuating arm 170 is lowered, piston valve actuator 142 is depressed and resets the piston valve.

In one example, the piston valve cuts off after approximately 3 minutes. This time setting, or corresponding flow, may be different in other examples. It is generally desirable to set this the closing time or volume such that the piston valve cutoff occurs after the fill valve closes.

When the toilet is flushed, the following steps are performed

- The piston valve is opened for a fixed flow volume or fixed duration;
- The fill valve is opened;
- If the flapper closes properly, and if the fill valve is adjusted properly and operating properly, then the fill valve will close when the tank is filled;
- independently of the fill valve operation, the piston valve will close.
- The piston valve is reset during the next flush event, such as when the second end portion 176 of the piston valve actuating arm depresses the piston valve actuator 142 as described above.

In the event that the flapper valve does not properly close, the fill valve may not close, but the piston valve will close and will avoid the continued waste of water.

In the event that the flapper valve closes, but leaks, the fill valve may close. If the fill valve does not have a float locking feature, then the float or other sensing element may cause the fill valve to reopen. However, the piston valve will prevent additional water from entering the tank until the tank is flushed again. This case is the same for other leaks from the tank.

In the event that the fill valve closes and leaks, the piston valve will close and will avoid the continued waste of water.

In the event that the fill valve is improperly adjusted, some water may overflow into an overflow tube, the piston valve will close and will avoid the continued waste of water.

Description of Embodiment

Dual Ball Cock and Piston Valve Assembly

In this embodiment, the fill valve is a ball cock valve rather than a float valve as described above.

Figure 4:
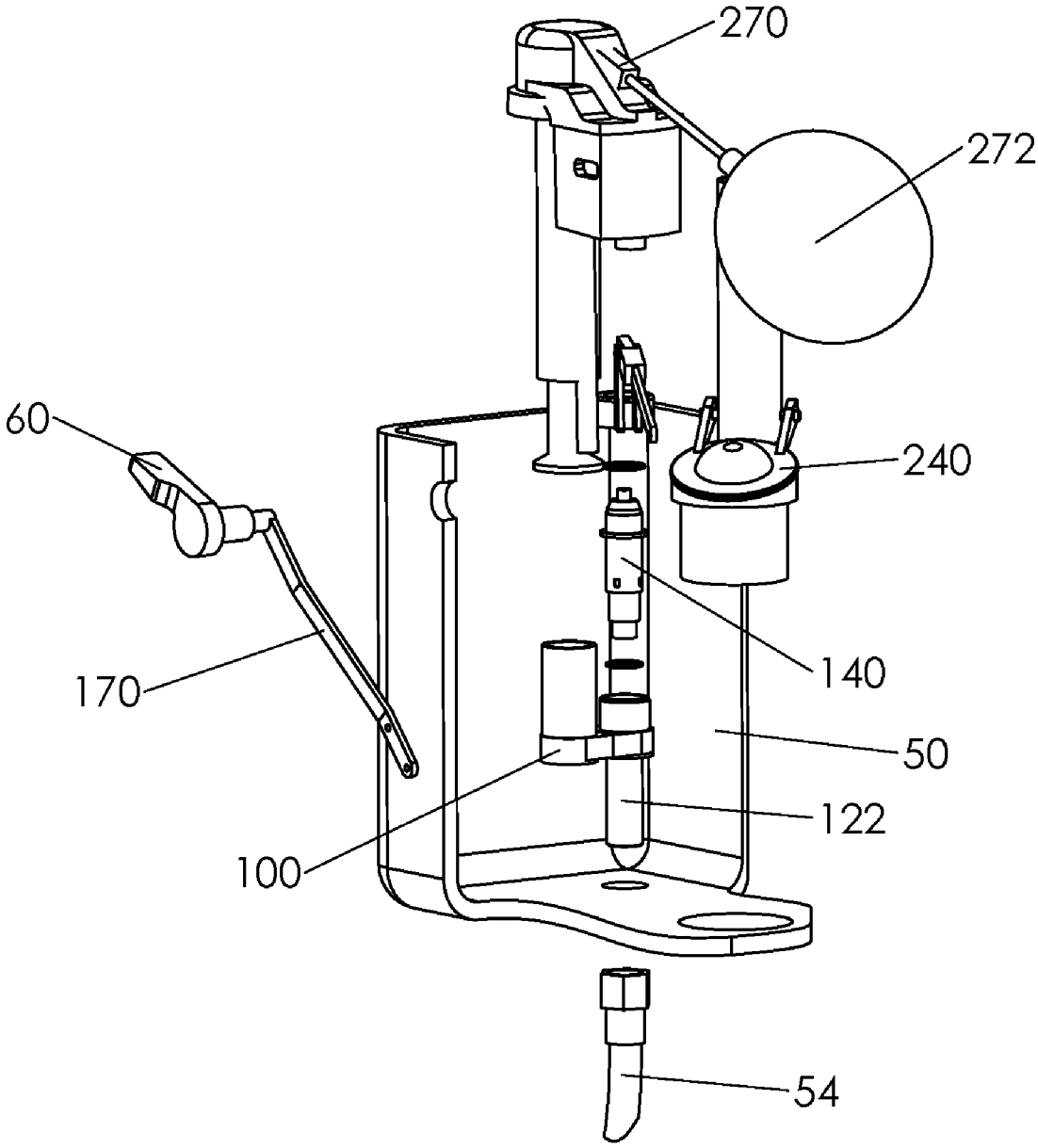
FIG. 4 is a perspective exploded view of a toilet tank with a ball cock valve embodiment of the device of the present invention.
Figure 5:
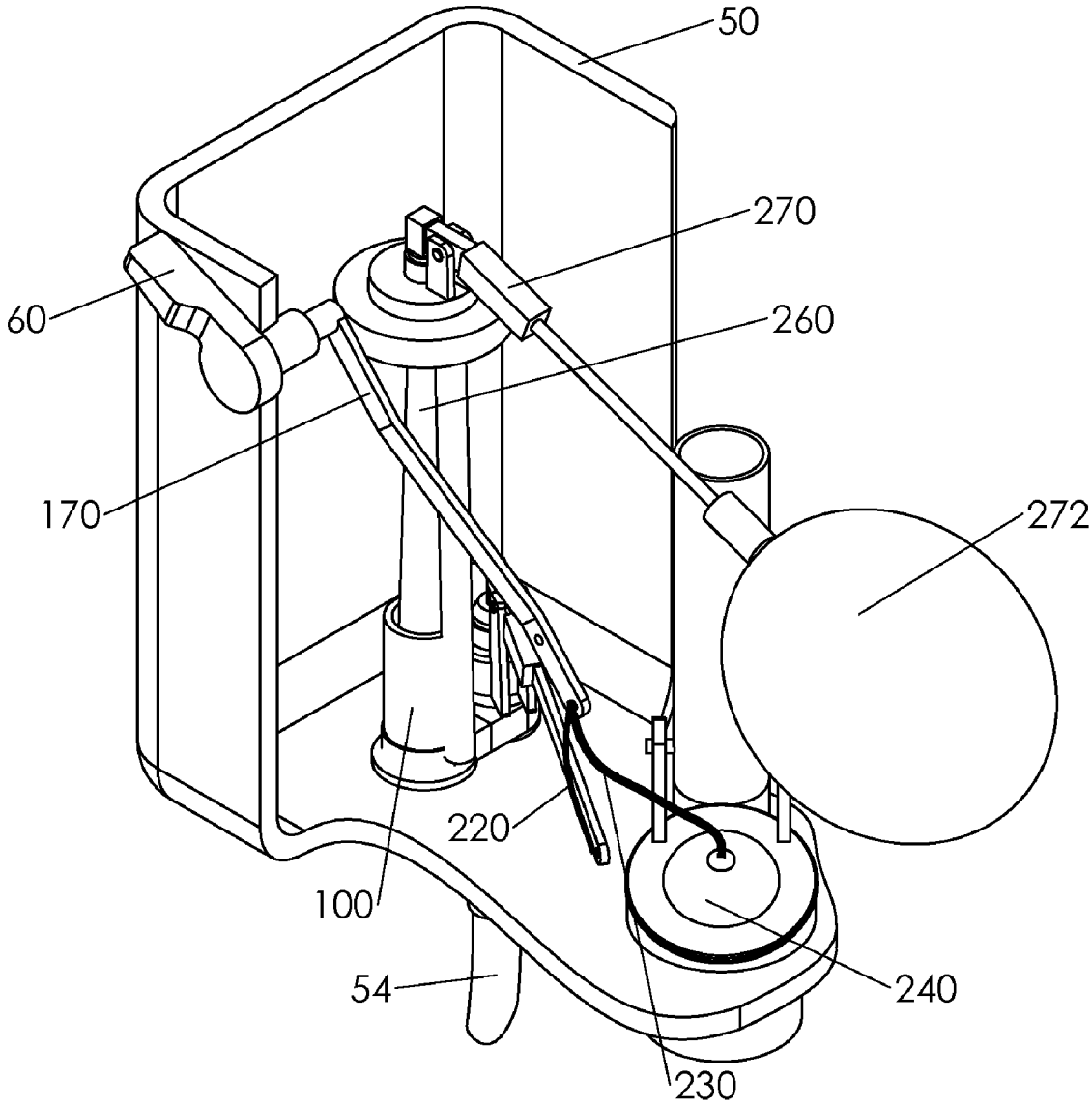
FIG. 5 is a perspective view of an assembled device of FIG. 4.

FIG. 4 is a perspective exploded view of a toilet tank with a ball cock valve embodiment of the device of the present invention. FIG. 5 is a perspective view of an assembled device of FIG. 4.

In this embodiment, a housing includes a fill valve support portion 124 supports a ball cock valve 270 which is controlled by a ball float 272.

In this embodiment, a water supply line 54 is provided at the tank near the water supply inlet hole 52 and is attached to a lower manifold portion 122. A piston valve 140 is provided in a piston valve housing 128 portion of the manifold. The piston valve may be actuated by a piston valve actuating arm 170 as described above.

Description of Embodiment

Single Part Dual Valve Device

In this embodiment, a single housing is provided. The housing may be manufactured from multiple parts, but is typically installed by the user as a single device.

In one example, the housing includes a lower manifold portion 122 which extends through a water supply inlet hole 52 and is attached to a water supply line 54 as described above. A fill valve is pre-attached to the housing or provided in an extended fill valve support portion 124. A piston valve is provided in the housing between the fill valve and the water supply line.

Description of Embodiment

Single Part Dual Valve Device with Replaceable Fill Valve

In this embodiment, a single housing is provided is provided as described above, but the fill valve is removably attached to the housing such that a replacement fill valve may be installed without removing the housing from the tank.

For example, the fill valve may be a short fill valve that has a threaded end for attachment to the housing. In this example, the old fill valve may be unthreaded and replaced with a new fill valve.

Description of Embodiment

Adapter Kit

In this embodiment, an adapter kit is provided for installation in the tank and for accepting a separate fill valve such as a float valve. The housing includes a lower manifold portion 122 which extends through a water supply inlet hole 52 and is attached to a water supply line 54 as described above. A fill valve attachment point, such as a female threaded joint is provided on the housing to accept a fill valve such as a float valve. A piston valve is provided in the housing between the fill valve and the water supply line.

Description of Embodiment

Replaceable Piston Valve

In this embodiment, a single housing or adapter kit is provided as described above, and the piston valve is replaceable.

In one example, the piston valve may be replaced by removing the piston valve cover element, replacing the piston valve, and replacing the cover.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A dual valve assembly for a toilet, the toilet having a tank and a water fill supply line, the dual valve assembly comprising a housing comprising an inlet section, such that the water fill supply line is attachable to the inlet section, a piston valve support section, and a fill valve support section oriented to a side of the piston valve support section;

a fill valve, such that the fill valve is supported by the housing fill valve support section;

a piston valve, supported in the housing piston valve support section, the piston valve comprising, an actuation element exposed outside of the housing piston valve support section, a water valve section, comprising a water valve, the water valve section sealed within the housing piston valve support section; and a metering orifice positioned between a first hydraulic chamber and a second hydraulic chamber, such that when the actuation element is engaged, a hydraulic fluid is forced into the first chamber where the hydraulic fluid then flows through a metering orifice into the second chamber, and the water valve is held opened while hydraulic fluid flows through the metering orifice; and a piston valve actuation arm engaging the piston valve actuation element, such that water is supplied from the water fill supply line to the piston valve and the fill valve in series.

2. The dual valve assembly of claim 1 wherein fill valve is a float valve.

3. The dual valve assembly of claim 1 wherein fill valve is a ball cock valve.

4. The dual valve assembly of claim 1 further comprising a piston valve actuation arm assembly comprising a pivotal mount supported by the housing, a first end of the piston valve actuation arm connected to a tank flush lever, and a second end of the piston valve actuation arm in proximity to the piston valve actuation element, such that when the tank flush lever is depressed, the first end of the piston valve actuation arm is raised, thereby causing the second end to engage the piston valve actuation element.

5. The dual valve assembly of claim 4 further comprising a chain adjustably connecting the first end of the piston valve actuation arm to the tank flush lever.

6. The dual valve assembly of claim 2 wherein the piston valve actuation arm assembly further comprises a cap attached to the piston valve support section of the housing, the cap comprising an open top to expose the piston valve actuation element;

an actuating arm support; and the piston valve actuation arm.

7. The dual valve assembly of claim 1 wherein the piston valve is positioned between the water fill supply line and the fill valve.

8. The dual valve assembly of claim 1 wherein the piston valve meters cumulative flow or duration of flow after the toilet is flushed.

9. An adapter for a toilet having a fill valve, the adapter comprising a housing comprising an inlet port, such that the inlet port is attachable to a water fill line, and an outlet port, such that the fill valve is attachable to the outlet port; and a piston valve positioned within the housing between the inlet port and the outlet port, the piston valve comprising, an actuation element exposed outside of the housing piston valve support section, a water valve section, comprising a water valve, the water valve section sealed within the housing piston valve support section; and a metering orifice positioned between a first hydraulic chamber and a second hydraulic chamber, such that when the actuation element is engaged, a hydraulic fluid is forced into the first chamber where the hydraulic fluid then flows through a metering orifice into the second chamber, and the water valve is held opened while hydraulic fluid flows through the metering orifice.

10. The adapter of claim 9 wherein the fill valve is threaded onto the outlet port.

11. The adapter of claim 9 further comprising a piston valve actuation arm assembly comprising a pivotal mount supported by the housing, a first end of the piston valve actuation arm connected to a tank flush lever, and a second end of the piston valve actuation arm in proximity to the piston valve actuation element, such that when the tank flush lever is depressed, the first end of the piston valve actuation arm is raised, thereby causing the second end to engage the piston valve actuation element.

12. A method for controlling the flow of water into a toilet tank, the method comprising providing a dual valve assembly comprising a housing comprising an inlet section, such that a water fill supply line is attachable to the inlet section, a piston valve support section, and a fill valve support section oriented to a side of the pistion valve support section, a piston valve supported in the housing piston valve support section, the piston valve comprising an actuation element exposed outside of the housing piston valve support section, a water valve section, comprising a water valve, the water valve section sealed within the housing piston valve support section; and a metering orifice positioned between a first hydraulic chamber and a second hydraulic chamber, such that when the actuation element is engaged, a hydraulic fluid is forced into the first chamber where the hydraulic fluid then flows through a metering orifice into the second chamber, and the water valve is held opened while hydraulic fluid flows through the metering orifice, and a fill valve connected to the outlet of the piston valve, the fill valve supported by the housing fill valve support section;

attaching the inlet section of the housing to a water fill supply line;

resetting the piston valve when a tank flush mechanism is engaged;

permitting water to flow through the piston valve and the fill valve; and closing the piston valve when an approximate flow volume is achieved.

13. The method of claim 12 wherein resetting the piston valve when a tank flush mechanism is engaged further comprises providing a piston valve actuation arm comprising a cap attached to the piston valve support section of the housing, the cap comprising an open top to expose an upper portion of the piston valve, an actuating arm support comprising a pivotal mount, and a piston valve actuation arm comprising a first end connected to a flush lever, and a second end in proximity to the piston valve actuation element, such that when the flush lever is depressed, the first end of the piston valve actuation arm is raised, thereby causing the second end to engage the piston valve actuation element and to reset the piston valve.

14. The method of claim 13 wherein providing a dual valve assembly further comprises providing an adapter kit comprising the housing;

placing the adapter kit in the toilet tank;

rotating the actuating arm support and piston valve actuation arm to a desired position; and attaching the fill valve to the fill valve support section.

* * * * *